US005306007A

United States Patent [19]

Scuteri

[11] Patent Number: 5,306,007

[45] Date of Patent: Apr. 26, 1994

[54] ASTROLOGICAL GAME APPARATUS

[76] Inventor: Fernando J. Scuteri, 804 San Pedro SE., Albuquerque, N. Mex. 87108

[21] Appl. No.: 44,757

[22] Filed: Apr. 12, 1993

[51] Int. Cl.[5] ..... A63F 3/00

[52] U.S. Cl. ..... 273/161; 273/239; 273/253

[58] Field of Search ..... 273/161, 250, 253, 239

[56] References Cited

U.S. PATENT DOCUMENTS

| | | | |
|---|---|---|---|
| 3,640,537 | 2/1972 | Klamer et al. | 273/161 |
| 3,746,344 | 7/1973 | Hodan | 273/161 X |
| 3,762,716 | 10/1973 | Horton | 273/161 |
| 4,193,213 | 3/1980 | Suda | 273/161 X |
| 4,779,870 | 10/1988 | Nichols | 273/161 |
| 4,779,871 | 10/1988 | Rasmussen | 273/161 |
| 4,962,930 | 10/1990 | Griffith | 273/161 X |
| 5,203,564 | 4/1993 | Bruzas et al. | 273/161 |

FOREIGN PATENT DOCUMENTS

| | | | |
|---|---|---|---|
| 2039753 | 8/1980 | United Kingdom | 273/161 |
| 2226908 | 7/1990 | United Kingdom | 273/161 |

*Primary Examiner*—William Stoll
*Attorney, Agent, or Firm*—Leon Gilden

[57] ABSTRACT

The apparatus includes a game board having an annular array of wedge-shaped segments arranged to receive disc members thereon, each of the wedge-shaped segments having association relative to a contrasting astrological "house", wherein each disc is arranged for representative indication of an associated planet, sun, and moon. Random depositing of the discs upon the game board relative to the segments arise for permitting individual interpretations of the interface of the astrological symbols in conflict relative to one another.

1 Claim, 4 Drawing Sheets

ASTROLOGICAL GAME APPARATUS

BACKGROUND OF THE INVENTION

1. Field of the Invention

The field of invention relates to astrological game structure, and more particularly pertains to a new and improved astrological game apparatus wherein the same permits individuals to randomly provide for interaction of astrological symbols relative to one another.

2. Description of the Prior Art

Astrological game apparatus is represented in the prior art by the U.S. Pat. Nos. 4,379,698; 3,786,654; 4,251,930; 3,992,787; and 4,472,144.

The instant invention addresses an improvement in the prior art by providing for a game apparatus accommodating the cooperative interface and interaction of the planets, sun, and moon relative to various Zodiac signs and in this respect, the present invention substantially fulfills this need.

SUMMARY OF THE INVENTION

In view of the foregoing disadvantages inherent in the known types of astrology apparatus now present in the prior art, the present invention provides an astrological game apparatus wherein the same permits the random interface of various planetary symbols in association with Zodiac houses. As such, the general purpose of the present invention, which will be described subsequently in greater detail, is to provide a new and improved astrological game apparatus which has all the advantages of the prior art astrological game apparatus and none of the disadvantages.

To attain this, the present invention provides an apparatus including a game board having an annular array of wedge-shaped segments arranged to receive disc members thereon, each of the wedge-shaped segments having association relative to a contrasting astrological "house", wherein each disc is arranged for representative indication of an associated planet, sun, and moon. Random depositing of the discs upon the game board relative to the segments arise for permitting individual interpretations of the interface of the astrological symbols in conflict relative to one another.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved astrological game apparatus which has all the advantages of the prior art astrological game apparatus and none of the disadvantages.

It is another object of the present invention to provide a new and improved astrological game apparatus which may be easily and efficiently manufactured and marketed.

It is a further object of the present invention to provide a new and improved astrological game apparatus which is of a durable and reliable construction.

An even further object of the present invention is to provide a new and improved astrological game apparatus which is susceptible of a low cost of manufacture with regard to both materials and labor, and which accordingly is then susceptible of low prices of sale to the consuming public, thereby making such astrological game apparatus economically available to the buying public.

Still yet another object of the present invention is to provide a new and improved astrological game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
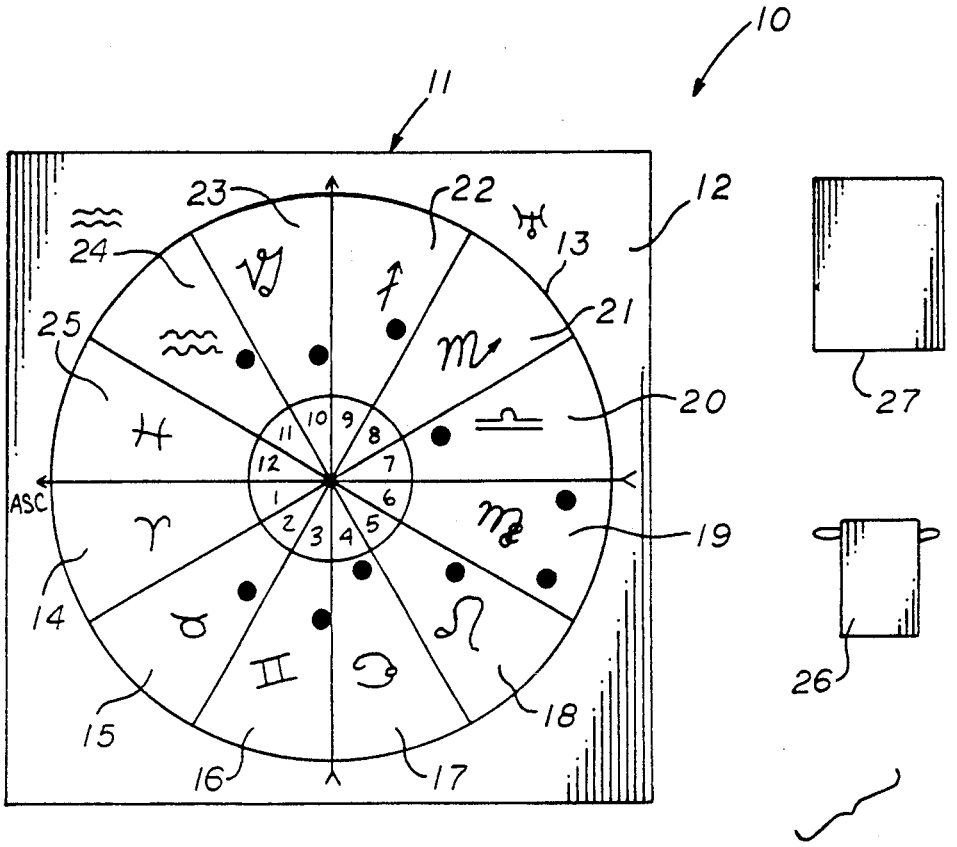
FIG. 1 is an orthographic view of the invention.
Figure 2:
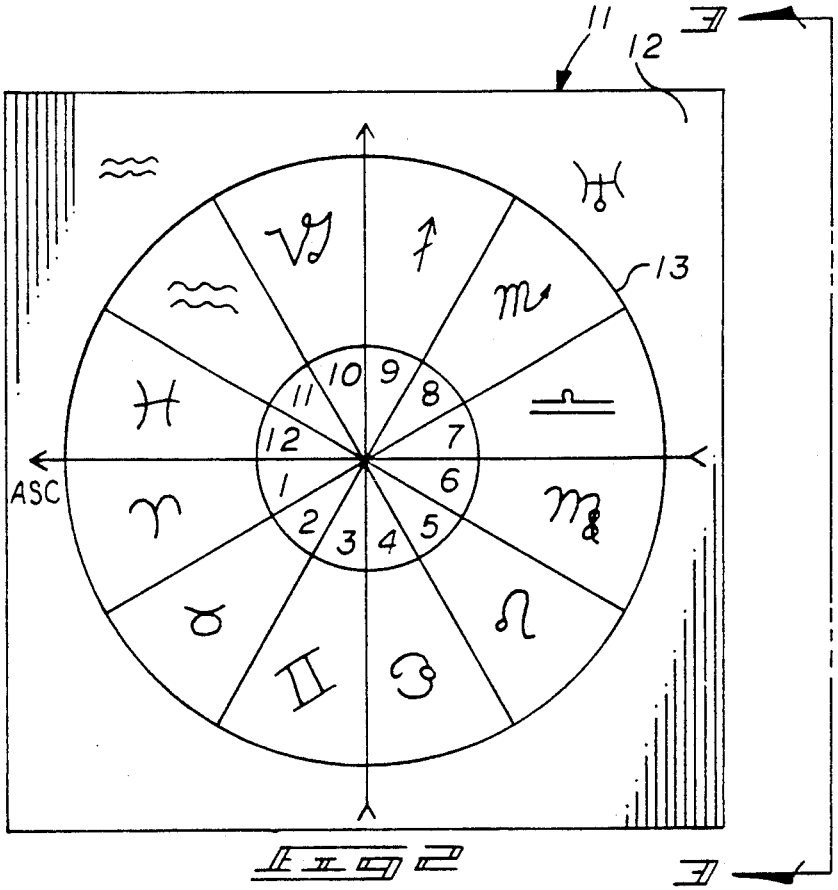
FIG. 2 is an orthographic top view of the game board.
Figure 3:
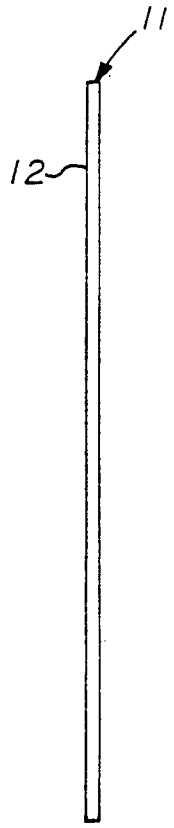
FIG. 3 is an orthographic view, taken along the lines 3—3 of FIG. 2 in the direction indicated by the arrows.
Figure 4:
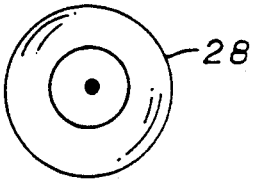
FIGS. 4, 5, 6, 7, 8, 9, 10, 11, 12, and 13 are top respective orthographic view of the discs representative of the planets, sun, and moon.
Figure 5:
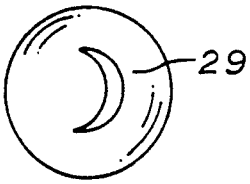
Figure 6:
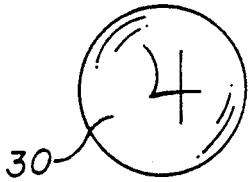
Figure 7:
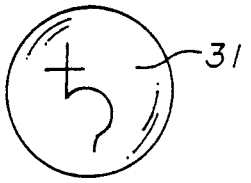
Figure 8:
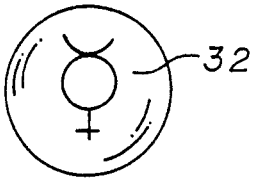
Figure 9:
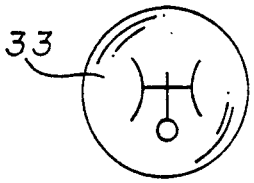
Figure 10:
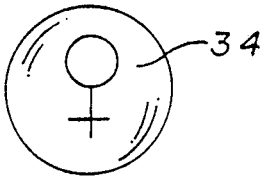
Figure 11:
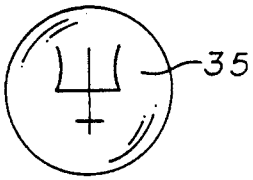
Figure 12:
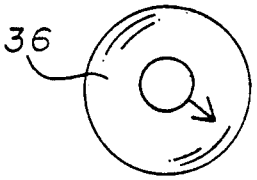
Figure 13:
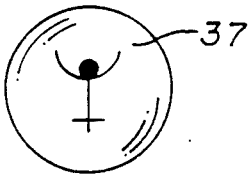
Figure 14:
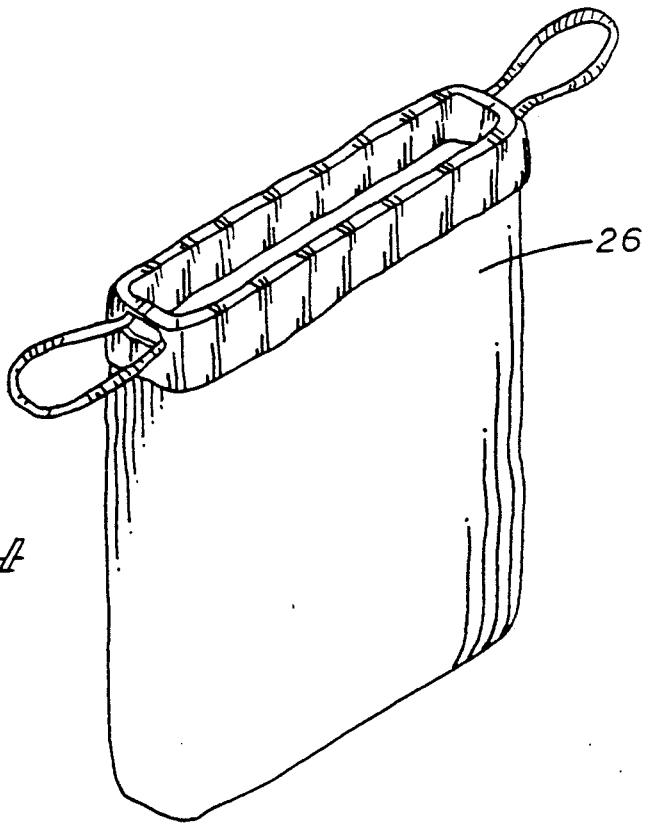
FIG. 14 is an isometric illustration of the pouch structure arranged for accommodating the various discs, as indicated in the FIGS. 4–13.
Figure 15:
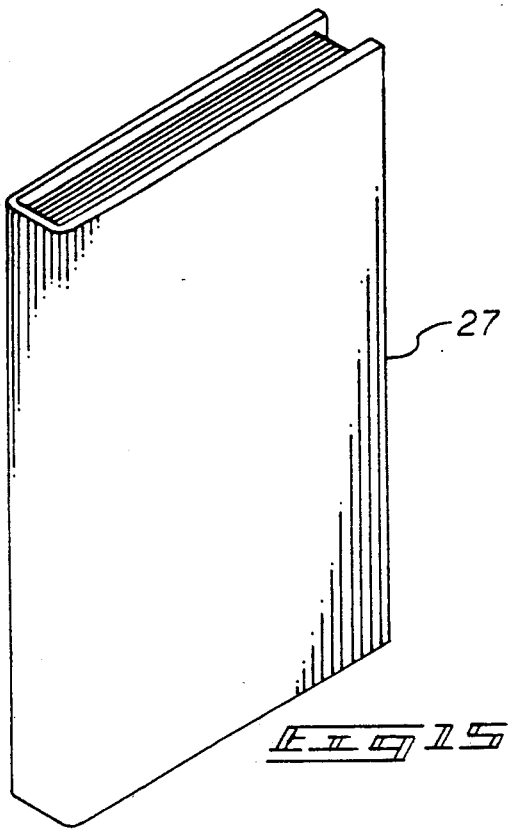
FIG. 15 is an isometric illustration of an astrological reference for permitting individual interpretations of the interface and interaction of the discs relative to the game board 11.

With reference now to the drawings, and in particular to FIGS. 1 to 18 thereof, a new and improved astrological game apparatus embodying the principles and concepts of the present invention and generally designated by the reference numeral 10 will be described.

More specifically, the astrological game apparatus 10 of the invention is arranged to accommodate the specific arena of HORARY Astrology. Reference for the interface and interaction of the planetary, sun, and moon in indication with the various Zodiac signs may be found by various available references to:

Horary Astrology, by Geraldine Davis
Horary Astrology, by Marc Edmund Jones and
Horary Astrology, by Robert De Luce
Simplified Horary Astrology, by Ivy M. Goldstein-Jacobson.

Further, a copy of an Ephemeris relative to astrological symbols for various calendar years is commercially available and helpful relative to permitting individuals to associate various interfaces of the planetary, sun, and moon designations with the Zodiac symbols as employed by the game apparatus.

The game apparatus per se, as indicated by the invention, is arranged to include a game board 11 having a top wall 12, including a circular target area 13 having wedge-shaped first through twelfth segment areas 14–25. The segment areas, such as the first segment area 14, indicates the first house of Aries; the second segment area 15 indicates the house of Taurus; the third segment area 16 indicates the house of Gemini; the fourth segment area 17 indicates the house of Cancer; the fifth segment area 18 indicates the house of Leo; the sixth segment area 19 indicates the house of Virgo; the seventh segment area 20 indicates the house of Libra; the eighth segment area 21 indicates the house of Scorpio; the ninth segment area 22 indicates the house of Sagittarius; the tenth segment area 23 indicates the house of Capricorn; the eleventh segment area 24 indicates the house of Aquarius; and the twelfth segment area 25 indicates the house of Pisces.

Ten token discs indicated by the first through tenth token disc 28–37 are provided and typically maintained during periods of storage and non-use in the pouch member 26. The first token disc 28 indicates the sun. The second token disc 29 indicates the moon. The third token disc 30 indicates the planet of Jupiter. The fourth token disc 31 indicates the planet of Saturn. The fifth token disc 32 indicates the planet of Mercury. The sixth token disc 33 indicates the planet of Uranus. The seventh token disc 34 indicates the planet of Venus. The eighth token disc 35 indicates the planet of Neptune. The ninth token disc 36 indicates the planet of Mars. The tenth token disc 37 indicates the planet of Pluto.

As indicated, the rule book representation 27 is referenced to the various Horary Astrology references, as indicated at the beginning of the specification.

Figure 16:
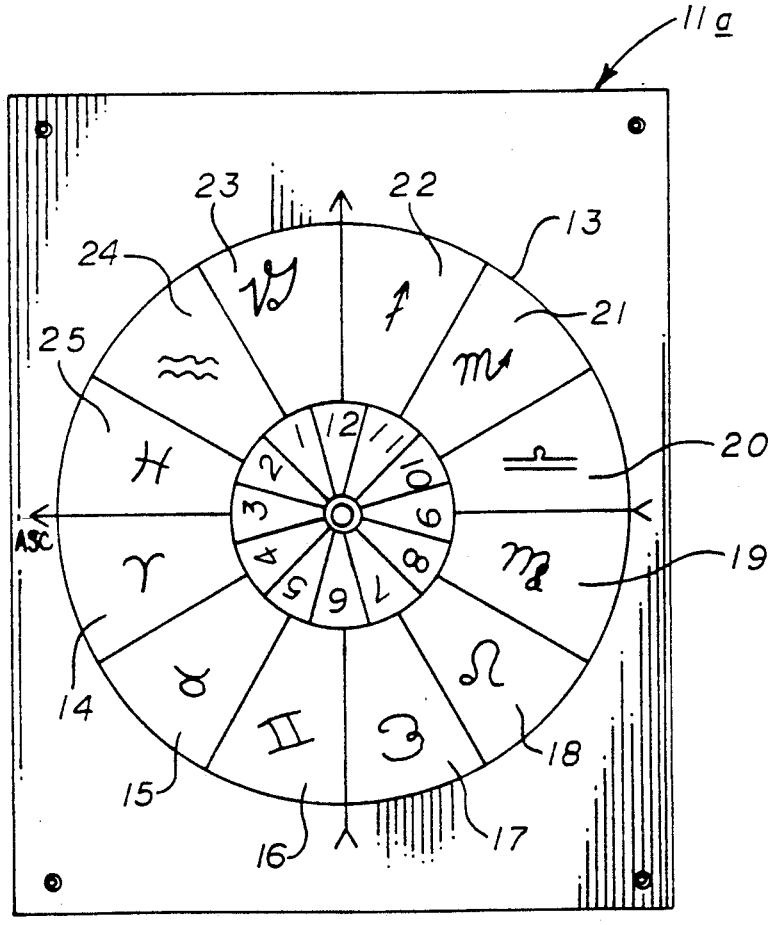
FIG. 16 is an orthographic view of a modified game board.
Figure 17:
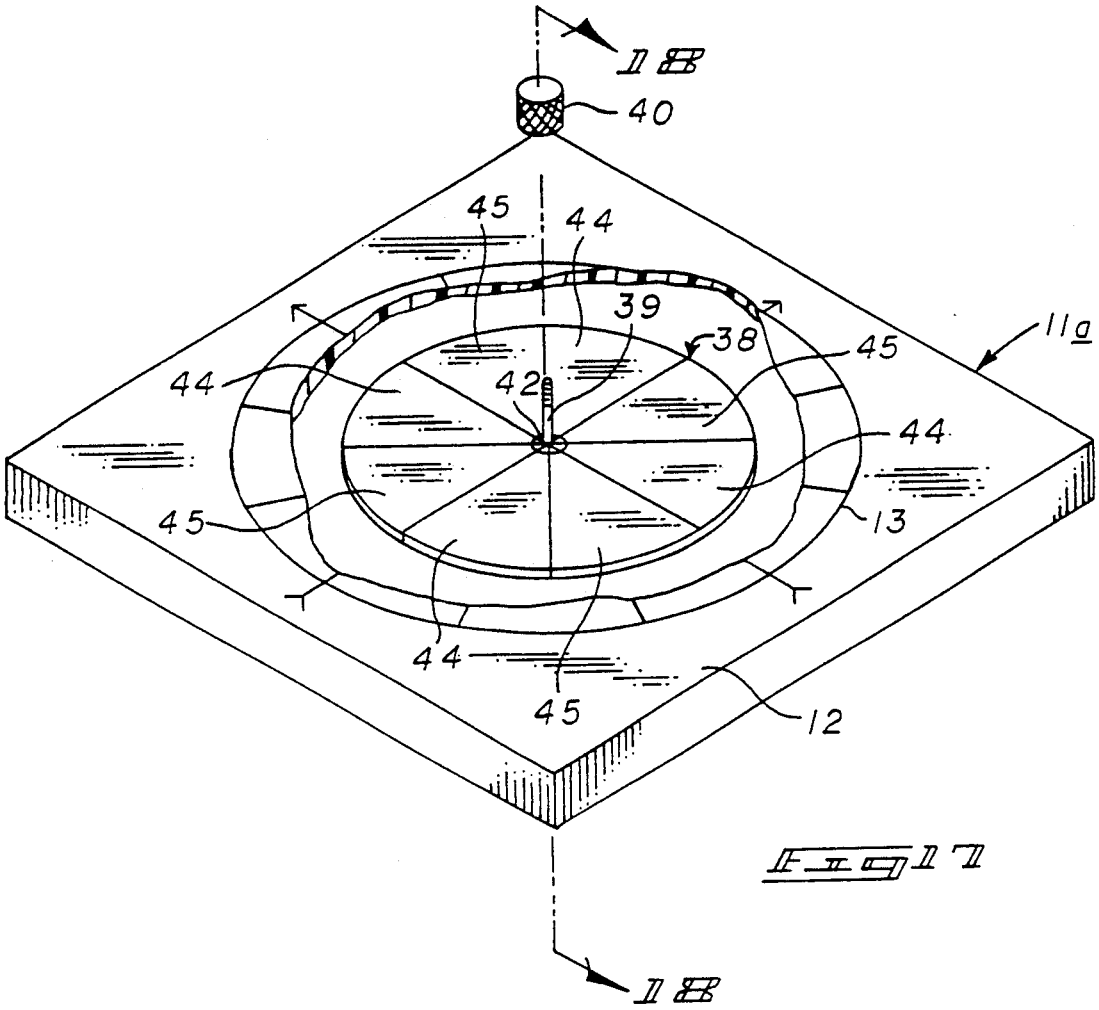
FIG. 17 is an isometric illustration of the modified game board, partially in section.
Figure 18:
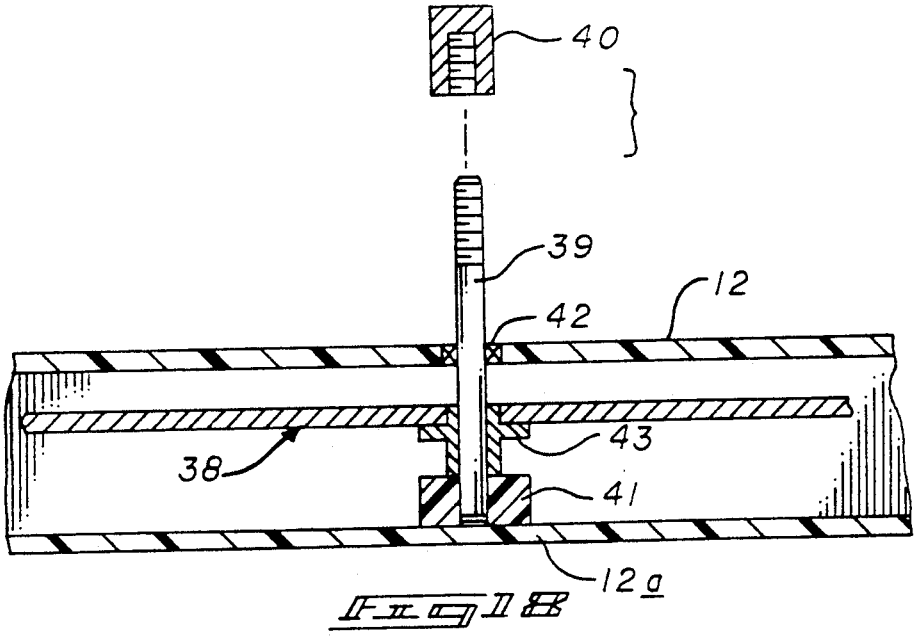
FIG. 18 is an orthographic view, taken along the lines 18—18 of FIG. 17 in the direction indicated by the arrows.

The FIGS. 16–18 indicates the use of a modified game board **11*a*, having a top wall 12 spaced from a bottom wall 12*a*. Within the game board cavity thusly defined between the top and bottom walls 12 and 12*a* respectively is a rotary cylindrical disc 38. The disc 38 is arranged parallel to and in adjacency to the top wall 12, having fixed concentrically thereto in a coaxial relationship a rotary axle 39 mounted coaxially of the rotary disc 38, as well as the circular target area 13 mounted at a lowermost end of the rotary axle 39 to a first bearing support 41, and through the top wall 12 in a second bearing support 42. A support spacer 43 positions the rotary disc 38 in a spaced relationship relative to the first bearing support 41. The disc 38 is formed of first and second wedge-shaped segments 44 and 45 respectively, wherein the first wedge-shaped segments 44 are of ferromagnetic construction, with the second wedge-shaped segments 45 of a non-magnetic material, such as polymerics or non-ferrous metallic material. Further, the token discs 28–37 in the construction are formed of a ferrous metallic material each, such that upon rotation of the rotary axle 39 and the rotary disc 38, enhanced random displacement of the token discs 28–37 onto the circular target area 13** is enhanced.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An astrological game apparatus, comprising, a game board, the game board including a game board top wall, and a circular target area imposed upon the top wall, with the circular target area including first, second, third, fourth, fifth, sixth, seventh, eighth, ninth, tenth, eleventh, and twelfth wedge-shaped segments directed concentrically relative to the target area, with each of the wedge-shaped segment areas of an equal predetermined configuration, and each of the segment areas representative of a contrasting Zodiac symbology, and first, second third, fourth, fifth, sixth, seventh, eighth, ninth, and tenth token discs, each representative of a contrasting planetary representation to include a sun representation and a moon representation permitting dropping of the token discs upon the target area for random positioning of the token discs upon the game board top wall, and the game board includes a bottom wall spaced from the top wall defining a board cavity therebetween, and a rotary cylindrical disc rotatably mounted intermediate the top wall and the bottom wall, the rotary disc having an axle, the axle fixedly and coaxially oriented through the rotary disc and the game board top wall terminating in a grasp knob spaced from the top wall, and the rotary disc formed of first wedge-shaped segments and second wedge-shaped segments in alternating orientation throughout the rotary disc, wherein the first wedge-shaped segments are of a ferromagnetic construction and the second wedge-shaped segments are of a non-ferromagnetic material, and wherein the token discs are of a ferrous metallic construction to impart random displacement of the token discs upon their being deposited upon the game board top wall.

* * * * *